US009828134B2

(12) United States Patent
Ziegler et al.

(10) Patent No.: US 9,828,134 B2
(45) Date of Patent: Nov. 28, 2017

(54) CANISTER WITH DISPERSING APERTURE

(71) Applicant: Robert A. Ziegler, New Brunswick, NJ (US)

(72) Inventors: Robert A. Ziegler, New Brunswick, NJ (US); Joel Carpenter, Doylestown, PA (US)

( * ) Notice: Subject to any disclaimer, the term of this patent is extended or adjusted under 35 U.S.C. 154(b) by 0 days.

(21) Appl. No.: 14/519,393

(22) Filed: Oct. 21, 2014

(65) Prior Publication Data

US 2015/0108130 A1 Apr. 23, 2015

Related U.S. Application Data

(60) Provisional application No. 61/893,533, filed on Oct. 21, 2013.

(51) Int. Cl.

| | |
|---|---|
| ***B65D 41/32*** | (2006.01) |
| ***B65D 17/00*** | (2006.01) |
| ***B65D 17/50*** | (2006.01) |

(52) U.S. Cl.

CPC ..... *B65D 17/161* (2013.01); *B65D 17/165* (2013.01); *B65D 17/502* (2013.01); *B65D 2517/0014* (2013.01); *B65D 2517/0067* (2013.01); *B65D 2517/5086* (2013.01)

(58) Field of Classification Search

CPC .. B65D 17/161; B65D 17/165; B65D 17/502; B65D 1/165; B65D 1/12; B65D 1/14; B65D 1/16; B65D 2517/0014; B65D 2517/0016; B65D 2517/0017

USPC ..... 220/604, 608, 610, 611, 612, 613, 656, 220/669, 675, 906

See application file for complete search history.

(56) References Cited

U.S. PATENT DOCUMENTS

| | | | | | |
|---|---|---|---|---|---|
| 1,765,794 | A * | 6/1930 | Hirth | B65D 1/06 | 215/378 |
| 2,384,810 | A * | 9/1945 | Calleson | B65D 7/04 | 220/62 |
| 2,629,534 | A * | 2/1953 | Reynolds | B21D 51/2676 | 220/359.3 |
| 3,820,368 | A * | 6/1974 | Fukuzuka et al. | B21D 22/28 | 413/1 |
| 5,522,521 | A * | 6/1996 | Nagashio | B21D 51/383 | 220/269 |
| 5,725,120 | A * | 3/1998 | Ramsey | B65D 17/502 | 220/276 |
| 8,052,005 | B2 * | 11/2011 | Turner | B65D 17/06 | 220/269 |
| 8,534,490 | B2 * | 9/2013 | Chapin | B65D 17/165 | 220/729 |

* cited by examiner

*Primary Examiner* — Steven A. Reynolds
*Assistant Examiner* — Javier A Pagan
(74) *Attorney, Agent, or Firm* — Andrew L. Salvatore, Esquire

(57) ABSTRACT

A canister with a novel dispensing aperture is described. The aperture is located within a continuous surface opposite the seamed canister end. By thus locating the aperture, canister contents may be dispensed or sipped without the interference of debris-collecting grooves, seam edges, and sharp angles typical of canisters with dispensing apertures located on seamed ends.

18 Claims, 7 Drawing Sheets

CANISTER WITH DISPERSING APERTURE

CROSS REFERENCE TO RELATED APPLICATIONS

This application is a non-provisional application of, and claims priority to, provisional application U.S. Application 61/893,793 filed on Oct. 21, 2013. The above referenced prior application is hereby incorporated herein by reference.

TECHNICAL FIELD OF THE INVENTION

The present invention relates to canisters used to store, merchandise, and dispense liquids and particulates, and more particularly for beverage and food canisters that provide for more sanitary and easier to clean dispensing apertures and mouth interfaces.

BACKGROUND OF THE INVENTION

Canisters are well-known means of containing and dispensing a wide variety of beverages, liquids and granular products. An aluminum canister (often referred to as a can) is typically formed by stamping, drawing, pressing, ironing, or extruding a single continuous piece of metal into a single-walled body with an open end, as typified by Klocke in U.S. Pat. No. 2,289,199; then filled with product; and then sealed at the open end along the edges of the single-walled body with a second part attached to those edges using a seaming process as exemplified by Cospen et al. in U.S. Pat. No. 3,843,014. Once sealed, the canister end comprised primarily of the second part is called the sealed end.

For a person to access the contents of such a canister, there must be an aperture through which the contents may be dispensed. Such an aperture may be created with a secondary tool such as a can opener or the canister itself may contain means for a person to create or access an aperture without a secondary tool. For example, the canister may include a removable seal feature on or within the sealed end by which a person may access a preformed aperture on the sealed end such as described by Smith in U.S. Pat. No. 2,034,007, Mansho in U.S. Pat. No. 2,974,824, Reynolds et al. in U.S. Pat. No. 3,312,368, Reynolds and Davidson in U.S. Pat. No. 3,338,462, Kerwin and Erlandson in U.S. Pat. No. 4,029,033, and Manne et al. in US 2011/0011868; or the canister may have a feature with which a person creates a predefined aperture with a feature such as the well-known pull-tabs with scored tear strips exemplified by Kaminsky and Muldowney in U.S. Pat. No. 4,530,631 and Neiner in U.S. Pat. No. 6,234,336.

In the known art, when the canister design includes such features for a person to create or access a preformed or predefined aperture without a secondary tool, the resulting aperture is contained within or is directly adjacent to the sealed end.

Metal canisters are designed for maximum structural integrity; with the aforementioned seaming process, the result is a sealed end with complex contours and sharp angles of grooves, ridges and seams. These attributes are the cause of sub-optimal user experience. For example, people often consume contents directly from canisters, placing their lips on and around the dispensing apertures on sealed ends and therefore on complex contours and sharp angles which can cause mouth discomfort and liquid spills. As another example, the seamed edges can cause turbulence when pouring contents into other vessels, resulting in spills. Finally, the grooves, seams, and ridges on typical sealed ends may be unsanitary dirt-catching areas. This problem is well described by Chapin in U.S. Pat. No. 8,534,490.

Prior solutions to these problems are sub-optimal because they may require additional parts, or they may require lengthy manufacturing processes, or they may compromise advantages of the cylindrical canister form, such as fill-rate and the ability to stack many containers ("stackability"). One example of a secondary device to improve flow from a canister can be found in Koehler U.S. Pat. No. 3,258,168. Chapin suggests an add-on device to eliminate or reduce the impact of some grooves and edges in sealed can ends in U.S. Pat. No. 8,534,490. Both of these require the expense of add-on parts or devices. The drawn conical "Crowntainer" described in Calleson & Calleson's U.S. Pat. No. 2,384,810 provides a better drinking and pouring interface and could in theory maintain fill throughput rates but at the cost of stackability and pack-out efficiencies (the amount of content which can be contained within the number of containers which can be stacked within a given cubic unit.)

Accordingly, there remains a need for a simple affordable canister for dispensing liquids which does not contain grooves on or around the aperture, which collect dirt and debris and form an uncomfortable surface, for dispensing the contents of the canister. Further, there remains a need for a canister which allows for canisters to be easily stackable without grooves around the dispensing aperture. Additionally, there remains a need for a canister which does not require a secondary tool to access the contents of the canister. The subject invention overcomes the limitations of the prior art.

SUMMARY OF THE INVENTION

This invention improves the user experience for beverage cans by locating the dispensing aperture away from the sealed end, and therefore away from the problems associated with dispensing from apertures within or adjacent to the unsanitary and uncomfortable contours of sealed ends. In the preferred embodiment, a dispensing aperture is located within the canister wall opposite the sealed end. The aperture may be predefined by a scored tear strip or preformed during or after the canister body formation by die stamping, hydroforming, waterjet cutting, laser cutting, or similar processes. If it is predefined by a scored tear strip, a pull-tab or similar actuator may be applied. If it is preformed as a hole, the dispensing aperture may be closed by a watertight seal, such as a thermally-sealed polymer film membrane or an adhesive-backed metal sheet. The can is then filled in the traditional way, and a second sheet material—the traditional second end part (without any opening features)—is applied and sealed.

DETAILED DESCRIPTION OF THE INVENTION

This invention provides a canister for dispensing liquid or granular product without grooves near to the dispensing aperture. In a preferred embodiment, the invention is a beverage canister in which the canister body 9 is formed from a single continuous sheet of material. In a further preferred embodiment, the body is constructed of a metal such as aluminum, steel, tin, or copper. The body may also be constructed of a combination of a metal and a plastic such polyethylene terephthalate (PET), high density polyethylene (HDPE), and low density polyethylene (LDPE). In a preferred embodiment, the body is a single wall body.

Figure 1:
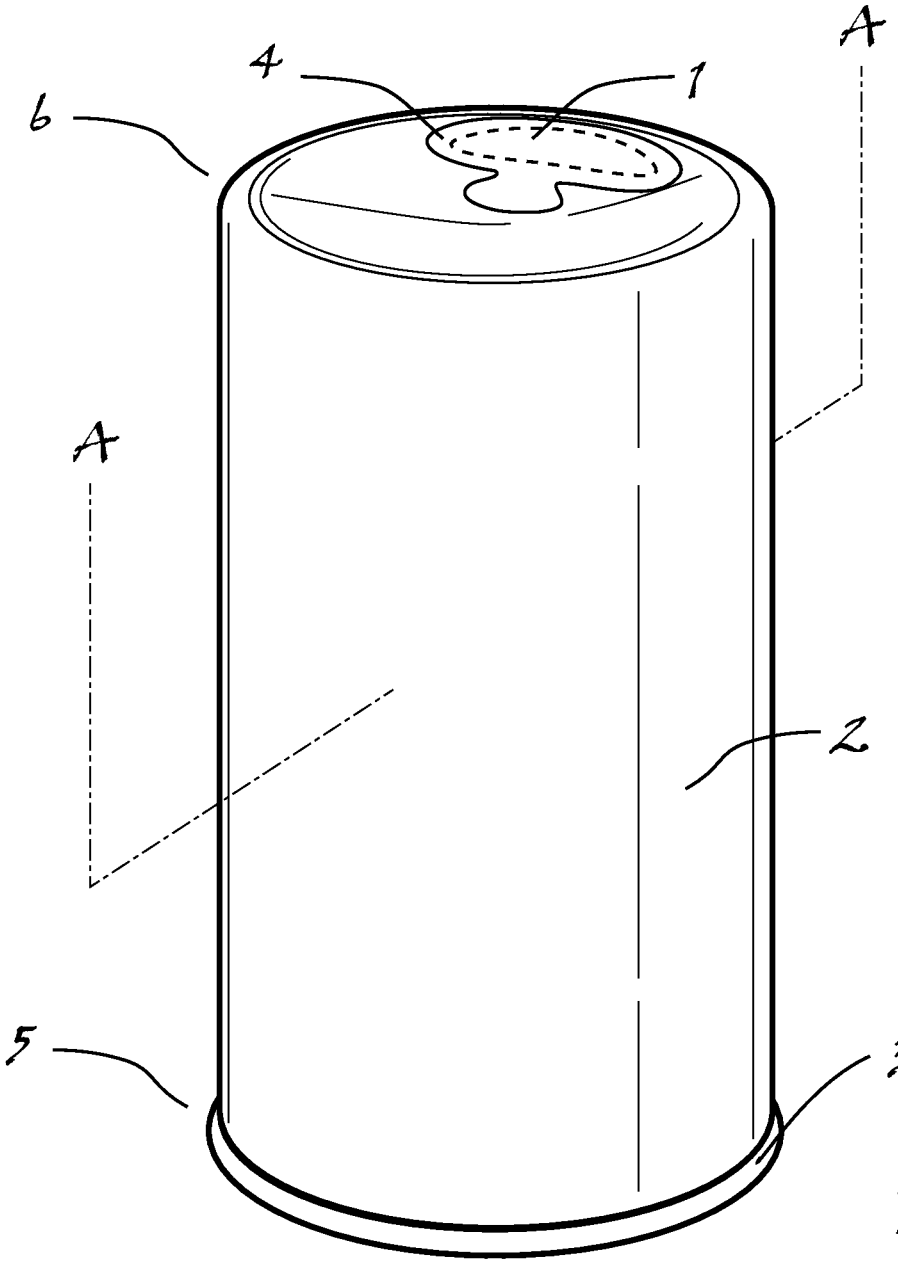
FIG. 1 shows a perspective view of an improved canister in embodiment showing a conical dispensing end and dispensing aperture with membrane seal according to the invention.
Figure 2:
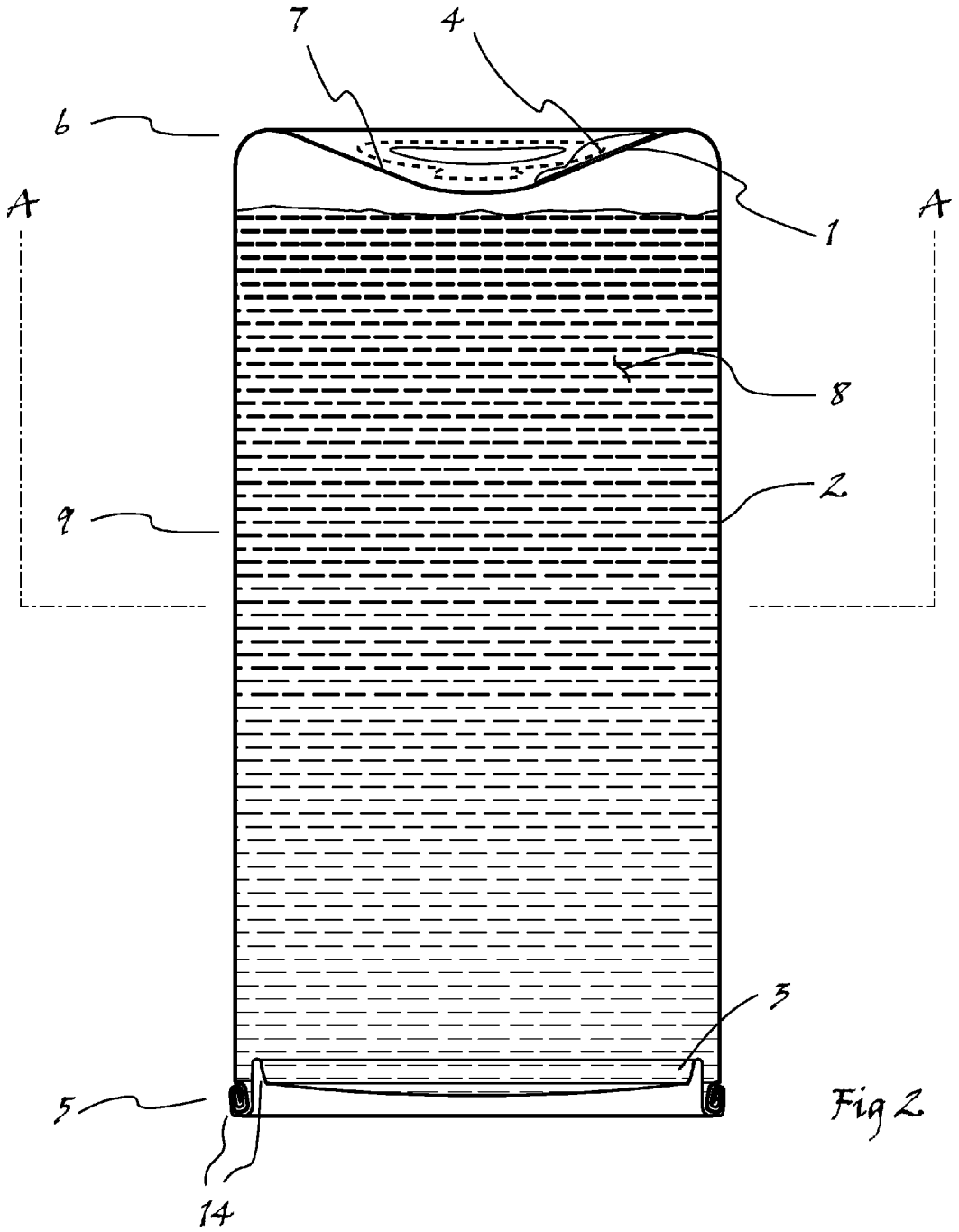
FIG. 2 shows a side cross sectional view of an improved canister taken at line A in FIG. 1 in embodiment showing a conical dispensing end and dispensing aperture according to the invention.
Figure 3:
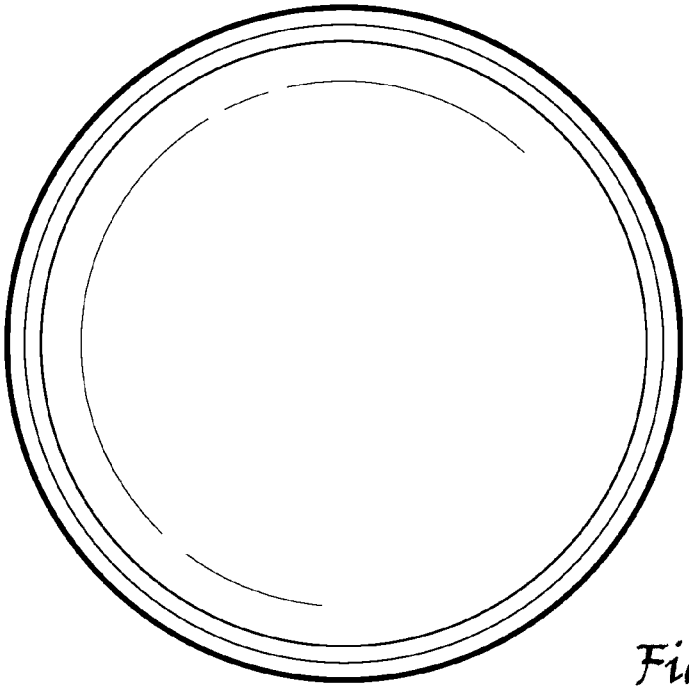
FIG. 3 shows a bottom plan view of an improved canister according to the invention.
Figure 4:
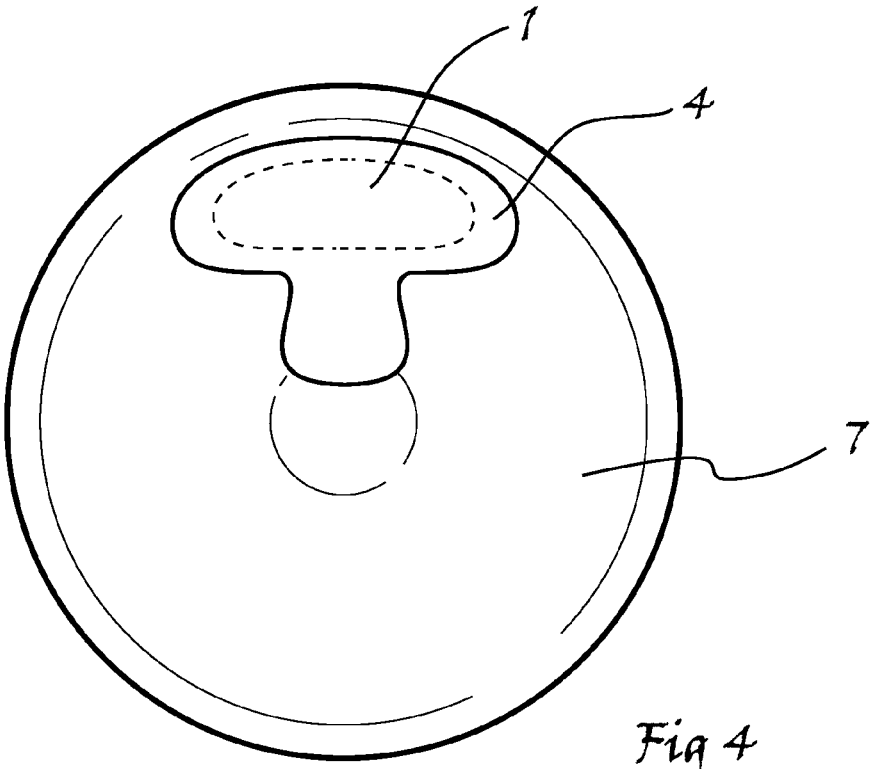
FIG. 4 shows a top plan view of an improved canister with dispensing aperture according to the invention.
Figure 5:
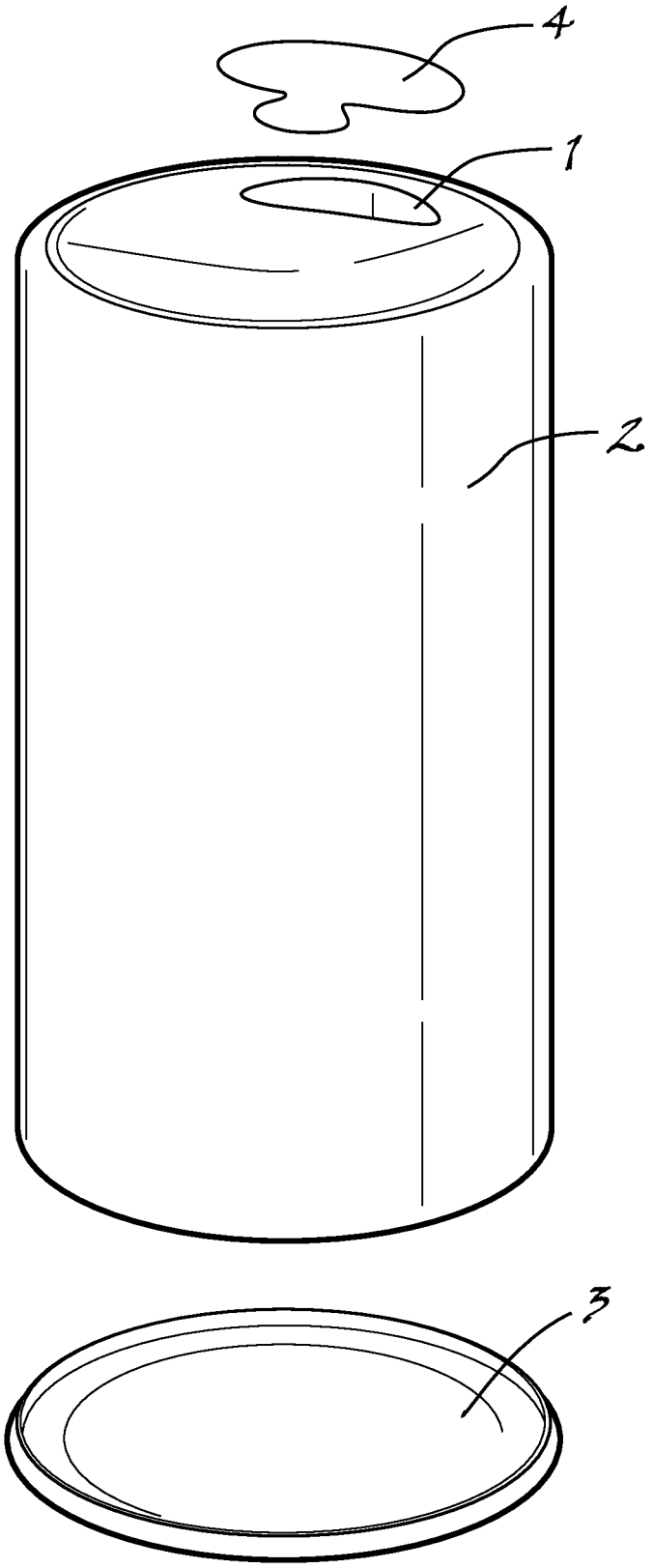
FIG. 5 shows an exploded perspective view of an improved canister in embodiment showing a conical dispensing end and dispensing aperture according to the invention.
Figure 6:
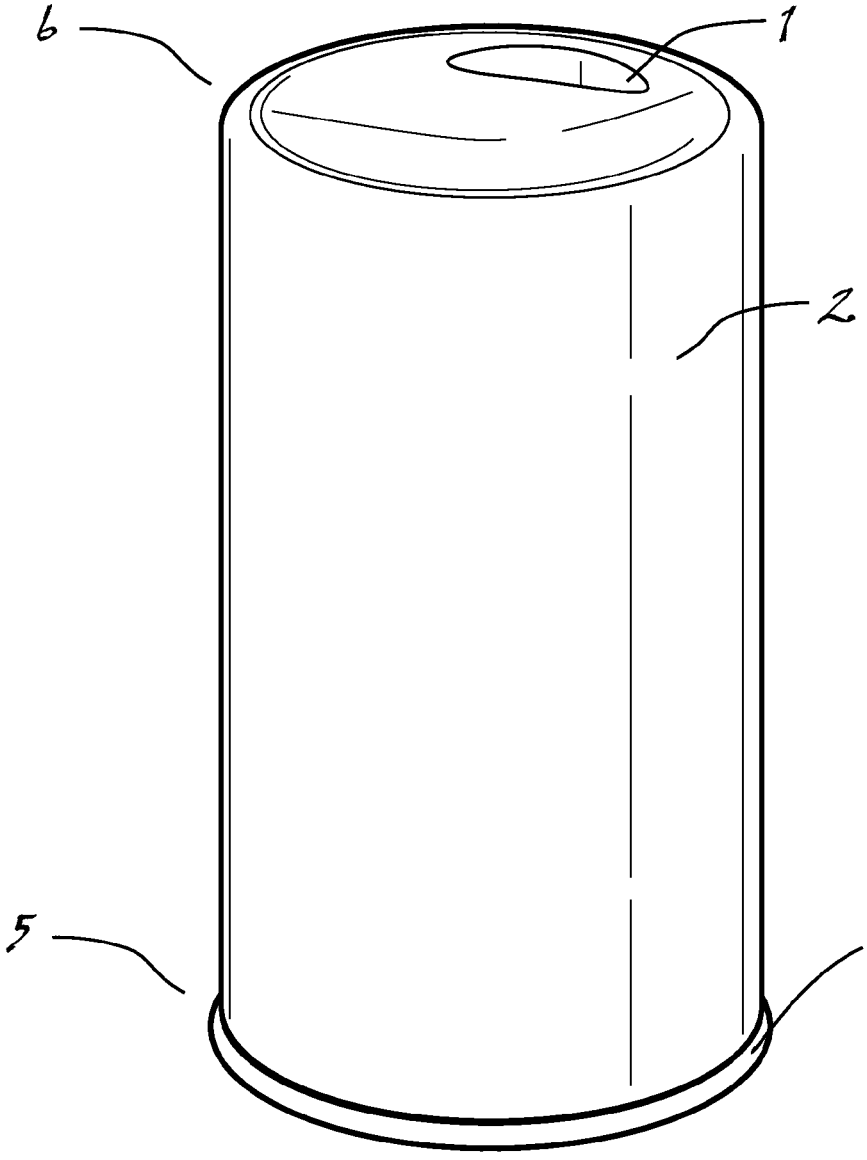
FIG. 6 shows a perspective view of an improved canister in embodiment showing a conical dispensing end and dispensing aperture according to the invention.

As is shown in FIGS. 1-8, the body may be formed in the shape of cylinder with a rounded side wall 2, dispensing end 6 and a sealed end 5. A second sheet material 3 is applied to the sealed end 5 of the body in order to close the sealed end of the cylinder. The second sheet material may be comprised of a metallic substance, the shape of which corresponds to the shape of the sealed end of the body. As shown in FIG. 2, in a preferred embodiment, the second sheet material is joined to the sealed end of the body by rolling and crimping together edges of the sealed end and edges of the second sheet material tightly to prevent the escape of liquids or granular contents from the sealed end. Joining the sealed end and body at the sealed end of the body creates a groove 14. However, as is noted throughout, the groove at the sealed end of the canister is opposite the dispensing end, and the mouth of a user will not come into contact the groove 14 when accessing the contents of the canister from the dispensing end.

A dispensing aperture 1 is positioned within the dispensing end 6 for dispensing the contents of the canister. The joinder of the sealed end and the second sheet material may form grooves 14 as a result of the joining process. However, the aperture in the dispensing end is located away from the sealed end, and no grooves are formed in the proximity of the aperture where a user may place his mouth to drink or eat the contents of the canister. The dispensing end may be flat. However, as shown in FIGS. 1 and 2 in particular, the dispensing end may contain a slight conical concave configuration. The conical concave configuration may be directed inwardly toward the interior of the canister and may comprise a conical wall 7 forming an inwardly projected conical configuration ending at a rounded apex also projecting inwardly toward the interior of the canister. Nonetheless, because the body is formed from a single continuous sheet of material, the rounded side wall is in continuous transition with the dispensing end with no grooves or other deformations which would normally be formed when two or more pieces of material are joined. The transition between the side wall and the dispensing end may be smooth and rounded to easily dispense the contents of the canister into a person's mouth.

The dispensing aperture 1 may be comprised of a hole cut into the dispensing end 6 to release the contents of the canister. To prevent the release of the contents of the canister prior to use, the dispensing aperture may be closed with a membrane seal 4. The membrane seal should be sized larger than the dispensing aperture 1 to cover the dispensing aperture. In operation, the user will remove the membrane seal to release the contents of the canister. The membrane seal may be constructed of a metal material and may be secured to the body 9 at the dispensing end 6 with an adhesive, a frangible weld, or a frangible solder. The membrane seal may alternatively be constructed of a polymer sheet and may be secured to the body at the dispensing end with an adhesive. Alternately, the polymer sheet may be thermally sealed and secured to body over the dispensing aperture at the dispensing end.

Figure 8:
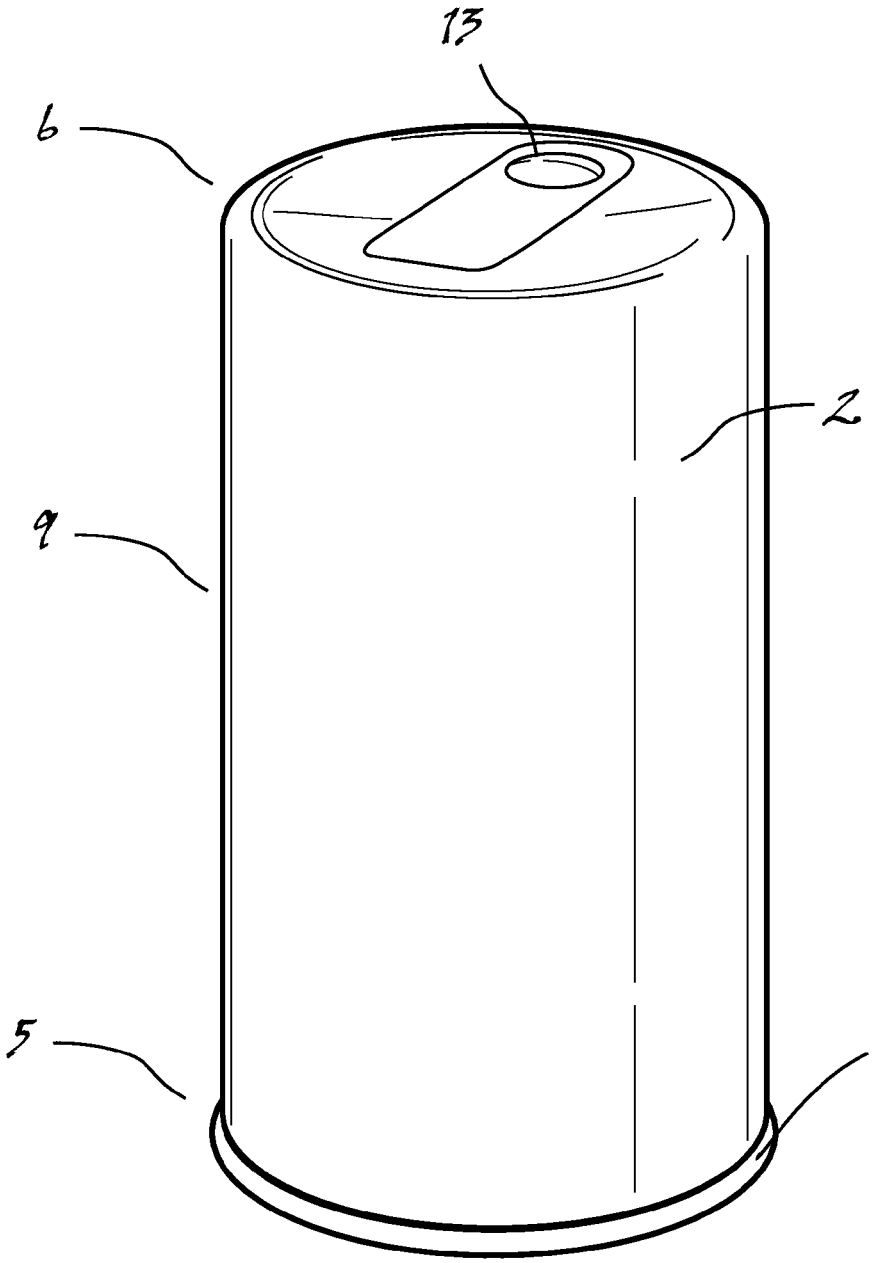
FIG. 8 shows a perspective view of an improved canister in embodiment showing a conical opening dispensing end and plug seal according to the invention.

In an alternate embodiment, as shown in FIG. 8, the dispensing aperture 1 may be dosed with a plug seal 13. The plug seal may contain a projection which is sized the fit tightly within the aperture to prevent release of the contents of the canister. The user may pull the plug seal from the dispensing aperture to release the contents of the canister. However, the user may again close the canister by reinserting the plug seal into the dispensing aperture.

Figure 7:
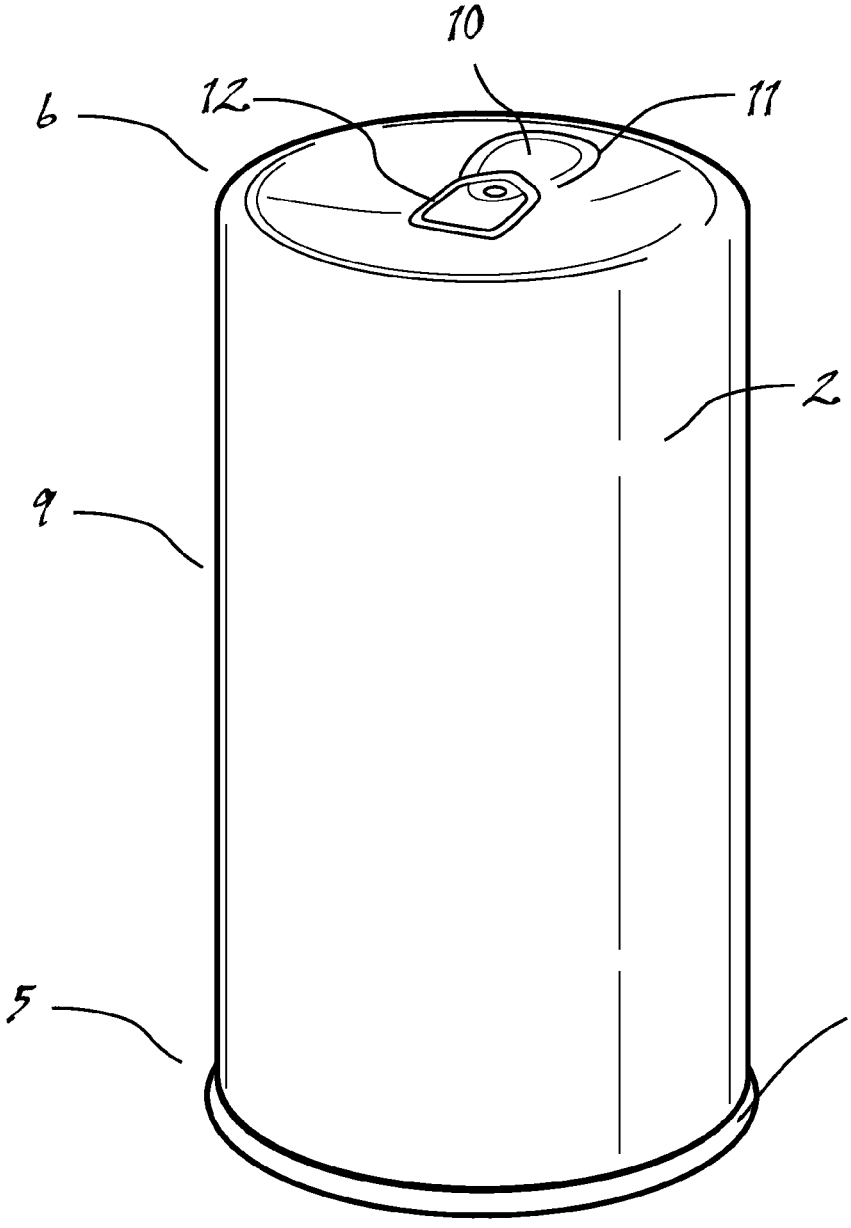
FIG. 7 shows a perspective view of an improved canister in embodiment showing a conical dispensing end and dispensing aperture with tear strip according to the invention.

In another alternate embodiment, as shown in FIG. 7, the dispensing end 6 may be contain a score line 11 which roughly defines at least 60% of the boundaries of a tear strip 10. The tear strip is located adjacent to a pull tab 12, a portion of which covers the tear strip. The pull tab is attached centrally to the dispensing end 6 of the body 9. In operation, the user pulls on the pull tab which presses against the tear strip pushing it toward the canister to release the contents 8 of the canister. The tear strip breaks away from the body at the score line and is bent into the interior of the canister while still remaining partially attached to the body. Dispensing aperture 1 is formed when the tear strip is separated in part from the body at the score line and pushed downward. The score line may be formed by die stamping, hydroforming, waterjet cutting, laser cutting, or similar processes.

The invention improves the user experience for beverage cans by locating the dispensing aperture away from the sealed end, and therefore away from the problems associated with dispensing from apertures within or adjacent to the unsanitary and uncomfortable contours of sealed ends. In the preferred embodiment, a dispensing aperture is located within the canister wall opposite the sealed end. The can is then filled in the traditional way, and a second sheet material applied at the sealed end of the body to close the canister.

The invention has been disclosed in terms of preferred embodiments which fulfill all of the objects of the present invention and overcome the limitations of the prior art. Various changes, modifications, and alterations from the teachings of the present invention may be contemplated by those skilled in the art without departing from the intended spirit and scope thereof. It is intended that the present invention only be limited by the terms of the appended claims.

What is claimed is:

1. A canister for dispensing liquids or granular particulates, comprising a single-wall body formed from a single continuous sheet of metal; a sealed end located at the edges of said body; the body being concave conically formed at an end opposite said sealed end, the conically formed portion comprising a conical wall and rounded apex projecting inwardly toward the interior of the canister, and a dispensing aperture positioned through the conical wall and opposite said sealed end.

2. A canister for dispensing liquids or granular particulates as in claim 1 wherein the metal is selected from the group consisting of aluminum, steel, tin, and copper.

3. A canister for dispensing liquids or granular particulates as in claim 1 wherein the body is comprised of metal and at least one plastic.

4. A canister for dispensing liquids or granular particulates as in claim 3 wherein the plastic is selected from the group consisting of polyethylene terephthalate (PET), high density polyethylene (HDPE), and low density polyethylene (LDPE).

5. A canister for dispensing liquids or granular particulates as in claim 1 wherein the aperture is present only after downward force is applied to a tear strip bordered by a continuous score which defines at least 60% of the borders of said aperture.

6. A canister for dispensing liquids or granular particulates as in claim 1 wherein the sealed end is formed from a second sheet material, the edges of which are joined to the edges of the body.

7. A canister for dispensing liquids or granular particulate as in claim 6 wherein the edges of the sealed end are joined to the edges of the body by rolling and crimping the edges together to form a tight seal.

8. A canister for dispensing liquids or granular particulates, comprising a single-wall body formed from a single continuous sheet of metal; a sealed end located at the edges of said body; the body being concave conically formed at an end opposite said sealed end, the conically formed portion comprising a conical wall and rounded apex projecting inwardly toward the interior of the canister, and a dispensing aperture closed with a removable seal, the aperture being positioned through the conical wall and opposite said sealed end.

9. A canister for dispensing liquids or granular particulates as in claim 8 wherein the seal is a membrane comprised of a metal sheet adhered to the body with adhesive.

10. A canister for dispensing liquids or granular particulates as in claim 8 wherein the seal is a membrane comprised of a metal sheet adhered to the body with frangible solder.

11. A canister for dispensing liquids or granular particulates as in claim 8 wherein the seal is a membrane comprised of a metal sheet adhered to the body with a frangible weld.

12. A canister for dispensing liquids or granular particulates as in claim 8 wherein the seal is a plug seal comprised of a flat material having two sides, one side having a projection sized to fit tightly within the aperture.

13. A canister for dispensing liquids or granular particulates as in claim 8 wherein the seal is a membrane comprised of a polymer sheet adhered to the body with adhesive or thermally sealed.

14. A canister for dispensing liquids or granular particulates, comprising:

a single continuous sheet of material forming a body comprising a cylindrical shape having a rounded side wall and a concave conically formed dispensing end, the conically formed portion comprising a conical wall and rounded apex projecting inwardly toward the interior of the canister, the side wall and dispensing end being in continuous transition;

a sealed end located at the edges of said body; and a dispensing aperture positioned through the conical wall of the dispensing end.

15. A canister for dispensing liquids or granular particulates as in claim 14 wherein the continuous transition between the side wall and the dispensing end is of a smooth and rounded construction to easily dispense the contents of the canister into a person's mouth.

16. A canister for dispensing liquids or granular particulates as in claim 14 wherein the continuous transition between the side wall and the dispensing end does not contain any continuous or semi-continuous annular grooves.

17. A canister for dispensing liquids or granular particulates as in claim 14 wherein the aperture is present only after downward force is applied to a tear strip bordered by a continuous score which defines at least 60% of the borders of said aperture.

18. A canister for dispensing liquids or granular particulates as in claim 17 wherein the downward force is applied to the tear strip by means of a pull tab.

* * * * *